US007963888B2

(12) United States Patent
Lutkov

(10) Patent No.: US 7,963,888 B2
(45) Date of Patent: Jun. 21, 2011

(54) SPORTS DEVICE

(75) Inventor: Artjom Lutkov, St. Johann/Tirol (AT)

(73) Assignee: Beco Beermann GmbH & Co. KG, Bad Salzuflen (DE)

( * ) Notice: Subject to any disclaimer, the term of this patent is extended or adjusted under 35 U.S.C. 154(b) by 0 days.

(21) Appl. No.: 10/590,611

(22) PCT Filed: May 7, 2004

(86) PCT No.: PCT/EP2004/004912

§ 371 (c)(1),
(2), (4) Date: Aug. 24, 2006

(87) PCT Pub. No.: WO2005/082466

PCT Pub. Date: Sep. 9, 2005

(65) Prior Publication Data

US 2007/0042873 A1 Feb. 22, 2007

(30) Foreign Application Priority Data

Feb. 27, 2004 (DE) ..... 20 2004 003 054 U

(51) Int. Cl.
*A63B 71/00* (2006.01)

(52) U.S. Cl. ..... 482/51

(58) Field of Classification Search ..... 482/55, 482/38, 62, 148, 44, 121–130, 139, 51, 14, 482/23, 46–49, 91–92, 102
See application file for complete search history.

(56) References Cited

U.S. PATENT DOCUMENTS

| | | | | |
|---|---|---|---|---|
| 3,256,015 | A * | 6/1966 | Perrin | 482/129 |
| 4,768,774 | A * | 9/1988 | Beasley | 482/111 |
| 4,861,300 | A * | 8/1989 | Casagrande et al. | 441/81 |
| 5,004,226 | A * | 4/1991 | Brown, Jr. | 482/126 |
| 5,399,139 | A * | 3/1995 | Malynowsky | 482/129 |
| 5,681,248 | A | 10/1997 | Vani | |
| 5,697,792 | A * | 12/1997 | Ladin | 434/254 |
| 5,772,484 | A | 6/1998 | Sikorski | |
| 6,238,324 | B1 * | 5/2001 | MacMillan | 482/121 |
| 6,949,035 | B1 * | 9/2005 | Halsworth | 473/453 |
| 7,291,101 | B2 * | 11/2007 | Deal | 482/126 |
| 2001/0049240 | A1 * | 12/2001 | Sanso et al. | 441/88 |
| 2002/0198081 | A1 * | 12/2002 | Chen | 482/23 |
| 2007/0117690 | A1 * | 5/2007 | Webber | 482/94 |
| 2007/0167298 | A1 * | 7/2007 | Bystrom | 482/93 |

FOREIGN PATENT DOCUMENTS

| | | |
|---|---|---|
| DE | 34 38 668 | 5/1985 |
| FR | 2 767 303 | 2/1999 |

* cited by examiner

*Primary Examiner* — Lori Baker
(74) *Attorney, Agent, or Firm* — George W. Neuner; Edwards Angell Palmer & Dodge LLP

(57) ABSTRACT

Sports equipment or a sports device is described. It has an elongated body equipped with two handles, which are configured to accommodate hands and/or feet. The elongated body can be elastically flexed in a longitudinal direction. In a preferred embodiment of the sports equipment or sports device, the elongated body is designed for use as a swimming float. The sports equipment or sports device is particularly suited for training, playing and/or exercising.

14 Claims, 2 Drawing Sheets

SPORTS DEVICE

BACKGROUND OF THE INVENTION

1. Field of the Invention

The present invention relates to a sports device or sports equipment comprising an elongated body. The sports device is particularly suited for training, playing and/or exercising purposes.

2. Description of Related Art

So-called expanders are examples for sports devices or sports equipments comprising two handles, between which pullable elastic strings are arranged.

From DE 34 38 668 A, a sports device comprising two handles is known, which are mutually connected by means of a flexible electric conductor.

Furthermore, there exists floating devices comprising elongated bodies. However, these are not or hardly suitable for training or exercising purposes.

It is an object of the present invention to provide a new sports device, with which the whole human body can be trained in an efficient manner.

SUMMARY OF THE INVENTION

The object is solved by a sports device comprising an elongated body (1), characterized in that the elongated body (1) is equipped with at least two handles (3), wherein the handles (3) are configured to respectively accommodate hands and/or feet (8; 9), and that the elongated body (1) can be elastically flexed from a longitudinal direction.

Preferred embodiments of the sports device of the invention include one or more of the following features:

a) the elongated body (1) is arranged in the form of a swimming float;
b) the elongated body (1) is formed of a material generating buoyancy in water;
c) the material generating buoyancy is a closed-cell foam;
d) the elongated body (1) in a resting position has the shape of a cylinder;
e) the elongated body (1) in a resting position has a shape, a cross-section of which in at least a main portion along the length of the body has the form of a circle, a half circle, a rectangle, a square, a polygon, a rhombus, a kite-form or a trapezoid;
f) the ends of the elongated body (1) are planar or round.
g) the elongated body (1) has a signal color at least on the surface (7);
h) the handles (3) are attached separately to the elongated body (1);
i) the handles (3) are attached close to the respective body ends (1*a*, 1*b*) by means of borings (2);
j) tube elements (5) are respectively inserted in the borings (2) through the body (1);
k) the handles (3) are formed, respectively identically or different from each other, by hoops and/or loops;
l) the handles (3) are formed of a stretchable element made of an elastically stretchable material, which is attached respectively to the elongated body (1);
m) the hoops and/or loops are at least partially enclosed by a cushioning (4) made of soft material;
n) the elongated body (1) is dimensioned such that it can be grasped or holded both in the resting position and in the operation status by means of a hand via one handle and by means of a foot of a person via another handle; and
o) the elongated body (1) in a resting position is about 2 to 15 cm in width and about 40 to 150 cm in length.

Furthermore, the invention provides an assembly comprising the sports device according to the invention.

Owing to the property of elastic flexibility from the longitudinal direction of the body as well as by the disposition of the handles, which respectively can accommodate hands and/or feet of a human person, the longitudinal body can be bent out of the original position or resting position by the force imparted by means of the handles, and subsequently can return again elastically (resilient or springly) into the original position or resting position. In addition to the elastic flexibility, the body itself and/or the handles attached to it may be elastically pullable or stretchable at the same time.

With the sports device according to the present invention, a variable training of the whole human body is enabled by using hands and/or feet at the same time. In addition, further advantages in comparison with the sports devices as mentioned above as well as in comparison with other conventional sports devices exists: the sports device according to the invention can be handled easily, it enables a physiologically favorable whole body training by one device only, and it may optionally be provided with a low dead weight. The sports device according to the invention opens new training possibilities in the field of coordination and balance and thus is well suited for rehabilitation purposes.

The principle of the present invention and the preferred embodiments thereof will be described in the following in further detail.

The sports device according to the invention comprises a (main) body, that constitutes a form defined by faces on all sides and that is elongated, i.e. has a length-to-width (aspect) ratio of higher than 1, preferably more than 10:1. Thus, the elongated body has in its resting position, i.e. in a non-flexed status, preferably the form of a cylinder. Other elongated forms such as cuboid, a bend elongated body, a prisma and the like are also possible. Furthermore, the elongated body may be designed in its shape, in its resting position, by its across-section such that the cross-section, at least in a portion, preferably principally and above all essentially along the whole length, has a form of a circle, a half circle, a rectangle, a square, an arbitrary polygon, a thrombus, a kite form, a trapezoid or the like. The size of the main body in resting position is preferably adjusted for providing favorable variable exercising possibilities such that the different handles of the sports device, namely both in the resting position and during operation, can properly accommodate the different hands and/or feet of the human person in a mutually separate manner. The width of the main body for example is about 2 to 15 cm, preferably about to 5 to 12 cm, and the length is for example about 40 to 150 cm, preferably about 50 to 100 cm.

The ends of a preferred elongated body are suitably designed in a planar or round manner.

In order to improve the visibility or the aesthetic appearance, the surface of the body is preferably colored. In particular, a signal color may be selected.

The desired elastic flexibility of the body from its longitudinal direction may be controlled and adjusted as described above by the elongated form, the cross-section of the body and/or by the selection of a suitable material of the body. As to the materials for the body, metals, metal alloys, composite materials and in particular plastics are contemplated, while multiple materials may be combined, and wherein the material (or the materials) may be present in the whole volume or—e.g. in a circumferential shell or in the core with one type of material on the one hand and in a circumferential envelope with another type of material on the other hand—a portion of the volume. In addition to the elastic flexibility, the material for the body may at the same time be stretchable.

In a particularly preferred embodiment, the elongated body of the sports device according to the invention is designed as a swimming float. For this purpose, the elongated body is formed mainly or essentially from a material effecting buoyancy in water. As materials for effecting buoyancy, closed-cell foams are particularly suitable. Preferred base materials for the closed-cell foam substance are polyolefin (polyethylene or ethylene/vinylacetat-copolymers, particularly Evazote®), polyurethane, polystyrene and styrene-copolymers.

The handles directly or indirectly serve for accommodation or for being engaged with hands and/or feet of the person operating the sports device. Thereby, hands and/or feet, and in particular both the hands and the feet can be chosen independently from each other for grasping or holding the handles. According to a preferred development of the sports device of the invention, handles are disposed at ends or close to the ends of the flexible body, specifically at respectively opposite ends of the elongated body, in order to facilitate the operation and to improve whole body training. Preferably, the handles are not formed integrally with the main body itself, but separately or externally—respectively identical or mutually different—especially in the form of hoops and/or loops that are attached by suitable elements to the main body. A suitable attachment of the separate handles, in particular of the hoops and/or loops, is preferably effected via borings, which suitably exist at the ends or close to the ends. For providing handles in a form of hoops, these are preferably made for example of solid, non-stretchable material such as metal, a wire or wire coil or hard plastic. In a preferred embodiment the handle is formed in the form of a flexible, in particular stretchable loop in order to further improve exercising possibilities of the sports device. For example, a fiber fabric, a band of cloth, an elastomer and in particular an elastically stretchable plastic material such as a band made of latex or silicone may serve as the flexible material for the hoop and/or the loop of the handle. The hoop or the loop is suitably drawn through the aforementioned boring of the flexible body. In order to improve the flexibility of the sports device, the length of the hoop or the loop is preferably adjusted such that the hoop or the loop may be pulled over respective ends of the flexible body to the other side of the body.

In order to improve a feeling or a grasping capability, the handles, such as the afore mentioned hoops or loops, are enclosed at least partially, in any event in the handle portion, by a cushion made of soft material, e.g. Neopren® or, anyone of foam materials already mentioned above.

For guiding the external handles such as the aforementioned hoops or loops, tube elements, which are e.g. made of plastics, are suitably provided in the respective borings transverse to the main direction of the flexible body. The tube elements in the borings facilitate guiding the handles and additionally protect the flexible body, optionally made of soft materials, from tearing.

By means of the preferred features of the sports device of the invention described above, provided alone or in combination, a sports and animation device is created, with which multiple gymnastic exercises may be carried out. Depending on the optional design of the described measures, the sports device may be used as a training device, a stretching device and/or a massage device. The sports device may be operated by means of the handles by one or more persons with hands and/or feet, through one-sided and/or both-sided applicable or with concurrent grasping/holding. Depending on the selection of the material for the main body, the sports device of the invention is variably useable, for example solely for dry use when the base material has a negative buoyancy, but on the other hand advantageously, if desired in addition, for gymnastic exercises in aquatic sports when the base material has a positive buoyancy. In the latter case, and when properly designed in the form of a swimming float, the sports device according to the invention may serve both as a buoyant assisting tool as well as for increasing a mechanical resistance.

According to another aspect of the present invention, the sports device of the invention as described above is combined with at least one standing holder in an assembly which is advantageous in practice. The assembly may be simply accomplished by inserting the elongated body of the sports device of the invention into at least one standing holder.

BRIEF DESCRIPTION OF THE DRAWINGS

The present invention will be explained in more detail, in connection with drawings, by illustrative, preferred embodiments, which however are not to be understood in a limitive manner, wherein.

DETAILED DESCRIPTION OF THE INVENTION

Figure 1A:
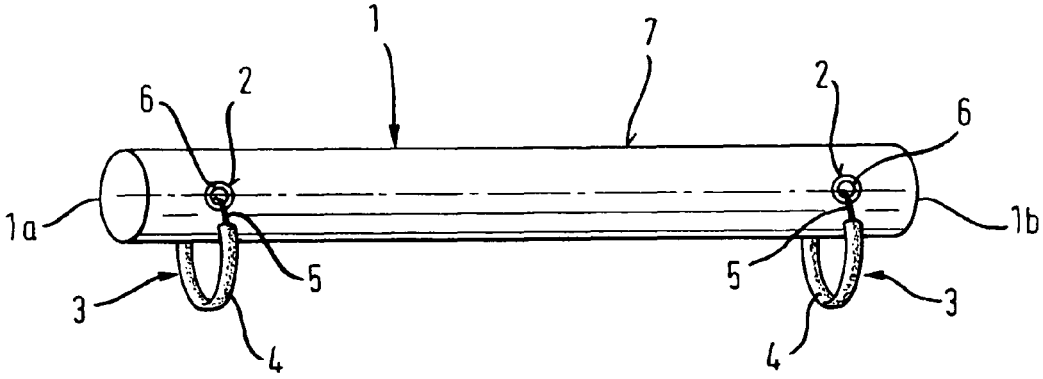
FIG. 1A shows a sports device according to the invention schematically in a resting position.
Figure 1B:
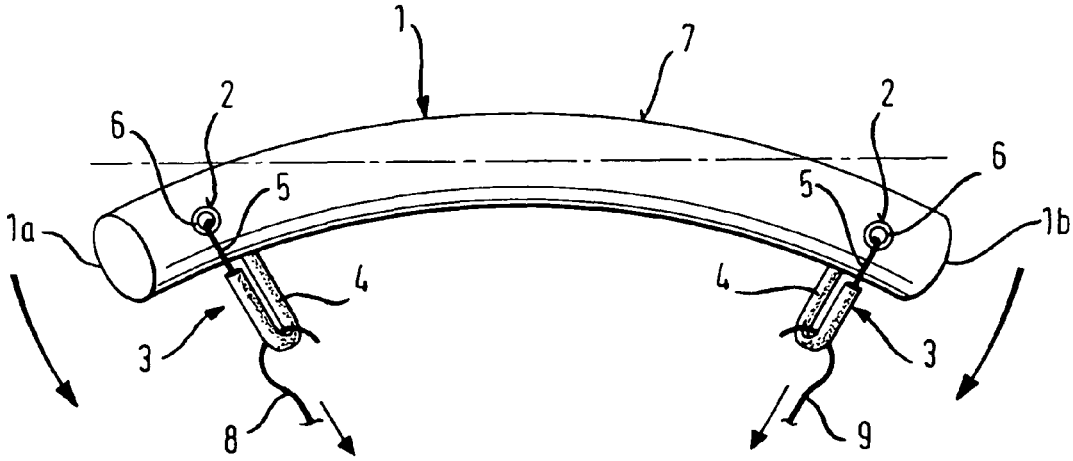
FIG. 1B shows the sports device according to the invention schematically during operation in a partially bended position according to a preferred embodiment of the invention.
Figure 2A:
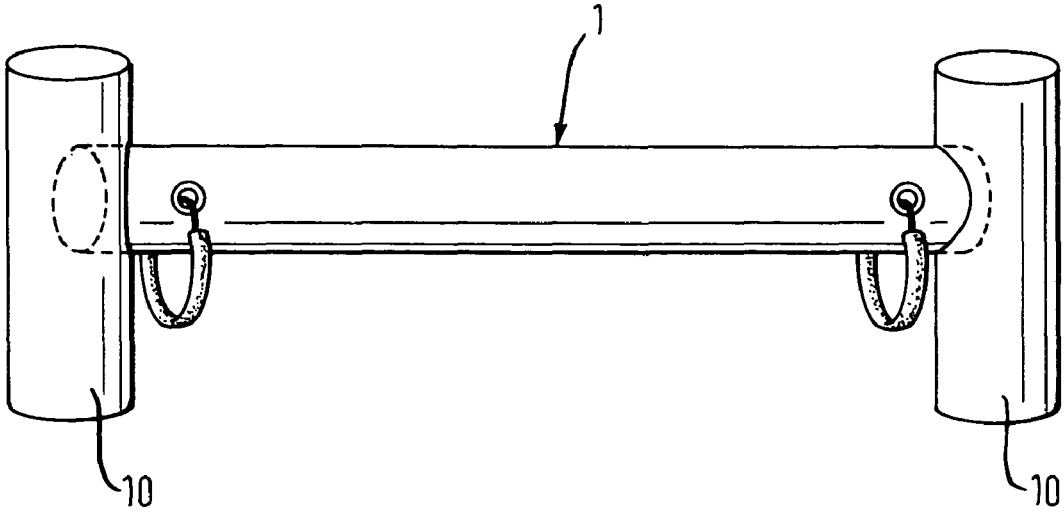
FIGS. 2A and 2B respectively schematically show an assembly of the invention comprising the sports device and two or one standing holders.
Figure 2B:
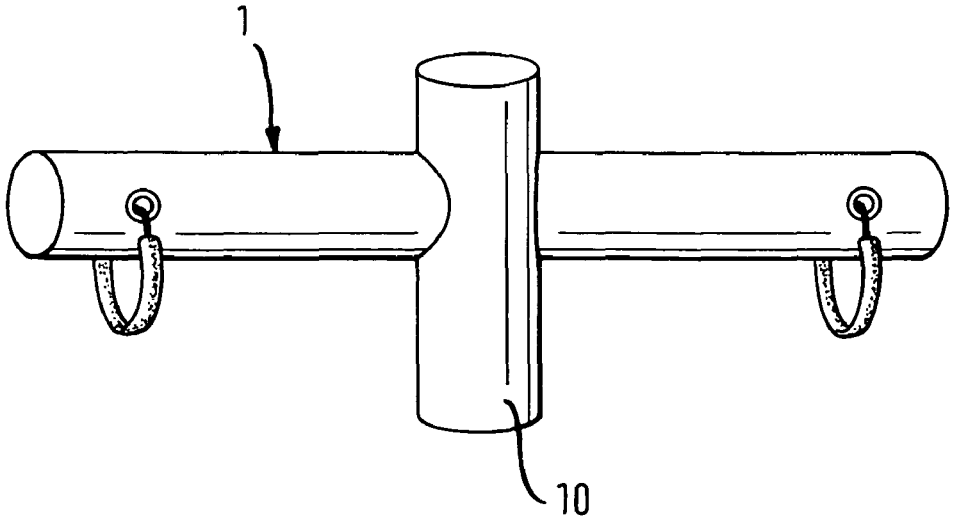

The sports device according to the invention, respectively shown in FIG. 1A in a resting position and in FIG. 2B during operation, comprises an elongated (main) body 1 in cylindrical form having rounded ends 1*a* and 1*b*. Here, the elongated body 1 is specifically made of a closed-cell foam material, 8 cm in width and 80 cm in length, having a signal blue color visible at the surface 7. Close to the respective ends, transverse to the longitudinal direction through the cylindrical body, borings 2 are disposed, into which plastic tube elements 6 are respectively inserted. Elastic bands 5 in the form of loops are drawn through respective boring elements 6. The elastic bands 5, together with a cushioning 4 provided in the handle section, from the respective separate handles 3 of the sports device. Hands or feet, which are schematically illustrated in FIG. 1B by reference signs 8 and 9, can easily grasp or hold these separate handles 3 and can impart a force onto the elongated body (illustrated in FIG. 1B by respective arrows at 8 and 9 in an exemplified manner) in order to bend the body out of the longitudinal axis illustrated by a dashed line. By the elasticity inherent to the body material, the body 1 is capable of springing, from the flexed status (FIG. 1B), again back into the starting position or resting position in an elastic manner. Owing to a possible, additional elasticity existing in the longitudinal direction—which optionally exists only or mainly with respect to the elastic bands 5—, the sports device may also be optionally stretched. In case of the embodiment according to FIG. 1A/1B, the pulling movements and/or stretching movements are additionally assisted by the stretching property of the elastic bands 5.

Since the flexible body 1 is formed of a foamed material having a buoyant power generated in water, the sports device shown in FIG. 1A/1B may be concurrently used advantageously for training, playing and/or exercising purposes in water.

In FIGS. 2A and 2B, examples for assemblies are shown, composed of the sports device of the invention including the (main) body 1, and respectively two (see FIG. 2A) or one (see FIG. 2B) standing holder(s) 10. The standing holders 10, which are formed of a suitable material such as plastic or metal, have corresponding recesses, into which respective ends of the cylindrically formed main body 1, as shown in FIG. 2A, or the middle portion of the cylindrical main body 1, as shown in FIG. 2B, are/is inserted by suitable engagement.

The sports device of the invention is by no means limited to the embodiments illustrated in the drawings or described above. Rather, various changes of the sports device are possible, e.g. with respect to embodying other materials, forms and sizes of the body, the type and the structure of the handles, the addition of further handles, the mounting of other technical and/or aesthetic elements, etc.

The invention claimed is:

1. A sports device comprising an elongated body extending in a longitudinal direction, the elongated body comprising at least two handles, wherein the handles are configured to respectively accommodate a hand or a foot, and wherein the elongated body can be elastically flexed from the longitudinal direction, the elongated body further comprising respective body ends and having borings transverse the longitudinal direction through the elongated body, wherein the handles are attached close to the respective body ends by said borings, wherein each handle is formed independently by a hoop and/or a loop, and wherein the handles are formed of a stretchable element made of an elastically stretchable material, which is attached respectively to the elongated body, to enable pulling movement for elastically flexing the elongated body from the longitudinal direction, and/or stretching movement in the longitudinal direction.

2. The sports device according to claim 1, wherein the elongated body is structured and arranged in the form of a swimming float.

3. The sports device according to claim 2, wherein the elongated body comprises a material generating buoyancy in water.

4. The sports device according to claim 3, characterized in that the material generating buoyancy is a closed-cell foam.

5. The sports device according to claim 1, wherein the elongated body has a resting position and, in said resting position, comprises a shape of a cylinder.

6. The sports device according to claim 1, wherein the elongated body has a resting position and, in said resting position, comprises a shape, a cross-section of which in at least a main portion along the length of the body has the form of a circle, a half circle, a rectangle, a square, a polygon, a rhombus, a kite-form or a trapezoid.

7. The sports device according to claim 1, the elongated body further comprising an end that is planar or rounded.

8. The sports device according to claim 1, the elongated body further comprising a surface having a signal color.

9. The sports device according to claim 1, wherein the handles are attached separately to the elongated body.

10. The sports device according to claim 1, further comprising tube elements respectively inserted through the body in the borings.

11. The sports device according to claim 1, wherein the hoop and/or loop comprise a cushioning made of soft material, which at least partially encloses hoop and/or loop.

12. The sports device according to claim 1, the elongated body further comprising a shape that is structured and arranged such that the elongated body can be grasped or held, both in a resting position and in an operating position, by a hand of a person via a first handle and by a foot of the person via a second handle.

13. The sports device according to claim 1, the elongated body further comprising a length and a width, wherein in a resting position the elongated body is about 2 to 15 cm in width and about 40 to 150 cm in length.

14. An assembly comprising a sports device according to claim 1 and at least one standing holder, into which the elongated body is inserted.

* * * * *